US009476297B2

(12) United States Patent
Logan et al.

(10) Patent No.: US 9,476,297 B2
(45) Date of Patent: Oct. 25, 2016

(54) TELEMETRY SYSTEMS WITH COMPENSATION FOR SIGNAL DEGRADATION AND RELATED METHODS

(71) Applicant: EVOLUTION ENGINEERING INC., Calgary (CA)

(72) Inventors: Aaron W. Logan, Calgary (CA); Jili Liu, Calgary (CA); David A. Switzer, Calgary (CA)

(73) Assignee: Evolution Engineering Inc., Calgary, CA (US)

( * ) Notice: Subject to any disclaimer, the term of this patent is extended or adjusted under 35 U.S.C. 154(b) by 0 days.

(21) Appl. No.: 14/894,366

(22) PCT Filed: May 30, 2014

(86) PCT No.: PCT/CA2014/050508

§ 371 (c)(1),
(2) Date: Nov. 26, 2015

(87) PCT Pub. No.: WO2014/190442

PCT Pub. Date: Dec. 4, 2014

(65) Prior Publication Data

US 2016/0130937 A1 May 12, 2016

Related U.S. Application Data

(60) Provisional application No. 61/829,964, filed on May 31, 2013.

(51) Int. Cl.
*E21B 47/18* (2012.01)

(52) U.S. Cl.
CPC ..... *E21B 47/18* (2013.01)

(58) Field of Classification Search
CPC .... E21B 47/18; E21B 47/182; E21B 47/185; E21B 47/187; E21B 47/091; E21B 47/00; G01N 29/032; G01N 2291/015; G01N 29/024; G01N 2291/011
See application file for complete search history.

(56) References Cited

U.S. PATENT DOCUMENTS

| | | | | |
|---|---|---|---|---|
| 5,130,950 | A * | 7/1992 | Orban | B06B 1/0681 181/102 |
| 6,714,138 | B1 | 3/2004 | Turner et al. | |
| RE38,567 | E | 8/2004 | Gruenhagen | |
| 7,228,902 | B2 * | 6/2007 | Oppelt | E21B 47/12 166/250.02 |
| 7,250,873 | B2 * | 7/2007 | Hahn | E21B 47/18 340/853.1 |
| 7,994,932 | B2 | 8/2011 | Huang et al. | |

(Continued)

FOREIGN PATENT DOCUMENTS

WO 2013142754 A1 9/2013

*Primary Examiner* — An T Nguyen
(74) *Attorney, Agent, or Firm* — Oyen Wiggs Green & Mutala LLP

(57) ABSTRACT

This invention comprises systems, methods and apparatus for mud pulse telemetry involving sending benchmark pulses with known characteristics (such as amplitude or duration) from the surface to the BHA, measuring those characteristics at the BHA, using those measurements to predict the likely attenuation of downhole-to-surface mud pulse transmissions, and adjusting those transmissions to compensate for high attenuation or to obtain energy savings (or transmission rate increases) during low-attenuation conditions. Further refinements on these systems and methods, particularly concerning the use of signal-to-noise ratio measurements at the surface to more efficiently predict attenuation, are also disclosed.

56 Claims, 5 Drawing Sheets

(56) References Cited

U.S. PATENT DOCUMENTS

| | | | | |
|---|---|---|---|---|
| 8,174,404 | B2 * | 5/2012 | Hahn | E21B 47/18 340/854.3 |
| 8,689,884 | B2 | 4/2014 | Young et al. | |
| 2005/0260089 | A1 | 11/2005 | Hahn et al. | |
| 2006/0114747 | A1 * | 6/2006 | Hentati | E21B 47/18 367/83 |
| 2009/0192711 | A1 * | 7/2009 | Tang | E21B 47/12 702/6 |
| 2010/0188253 | A1 * | 7/2010 | Shearer | E21B 47/18 340/853.3 |
| 2011/0006910 | A1 | 1/2011 | Canwell et al. | |
| 2011/0205080 | A1 | 8/2011 | Millot et al. | |
| 2012/0132289 | A1 | 5/2012 | Kolle | |
| 2013/0154845 | A1 * | 6/2013 | Brooks | E21B 47/18 340/854.3 |
| 2014/0177388 | A1 * | 6/2014 | D'Angelo | E21B 47/0002 367/35 |
| 2016/0130937 | A1 * | 5/2016 | Logan | E21B 47/18 367/83 |

* cited by examiner

TELEMETRY SYSTEMS WITH COMPENSATION FOR SIGNAL DEGRADATION AND RELATED METHODS

CROSS-REFERENCE TO RELATED APPLICATION

This application claims priority from U.S. Application No. 61/829,964 filed 31 May 2013. For purposes of the United States, this application claims the benefit under 35 U.S.C. §119 of U.S. Application No. 61/829,964 filed 31 May 2013 and entitled TELEMETRY SYSTEMS WITH COMPENSATION FOR SIGNAL DEGRADATION AND RELATED METHODS which is hereby incorporated herein by reference for all purposes.

TECHNICAL FIELD

This disclosure relates to subsurface drilling, and specifically to telemetry between bottom hole assemblies and surface systems and operators. Embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. A downhole probe is typically suspended in a bore of a drill string near the drill bit. Some downhole probes are highly specialized and expensive.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

MP telemetry is subject to attenuation as the distance between the surface drill rig and subsurface BHA increases. This attenuation is typically a function of the type of mud (drilling fluid) being used, the surrounding formation, and other factors that may not be readily anticipated. As a consequence, mud pulse telemetry systems typically use relatively high-energy and/or longer-duration vibrations so as to ensure successful receipt of signals. The inventors have determined that such telemetry systems are not ideal since battery capacity in a given BHA and the time available to transmit data is often limited. Addressing the limited supply of energy at a BHA may be done by additional batteries, stopping drilling so as to replace exhausted batteries, providing a downhole power generator, or going without telemetry once batteries are exhausted. Accounting for longer-duration pulses (and a correspondingly lower data rate) sometimes comprises implementing additional telemetry methods or transmitting less data. Each of these options entails significant costs, risks, and/or undesirable complexity.

There remains a need for methods and systems for providing downhole telemetry systems that are more energy-efficient, have higher data rates, or both.

SUMMARY

The invention has a number of aspects. Some aspects provide mud pulse telemetry systems. Other aspects provide methods. Other aspects provide uphole or surface telemetry systems and/or apparatus. Other aspects provide downhole telemetry systems and/or apparatus.

Some embodiments of such telemetry systems, methods and/or apparatus comprise a first processor, a surface pulse generator, a surface pulse sensor, a downhole pulse generator in fluid communication with the surface pulse sensor, and a downhole pulse sensor in fluid communication with the surface pulse generator.

The surface pulse generator may be configured to transmit to the downhole pulse sensor a benchmark pulse with a known characteristic by mud pulse telemetry. The downhole pulse sensor may be configured to receive the benchmark pulse and to measure the known characteristic of the benchmark pulse. The first processor may be configured to, in response to the downhole pulse sensor's measurement of the known characteristic of the benchmark pulse, determine an attenuation prediction factor. The downhole pulse generator may be configured to transmit to the surface pulse sensor a set of one or more mud pulses according to the attenuation prediction factor. The surface pulse sensor may be configured to receive the set of one or more mud pulses.

An aspect comprises configuring the first processor to determine the attenuation prediction factor according to the following formula:

$$\text{attenuation prediction factor} = \frac{C_S - C_D}{C_S}$$

where $C_S$ is the value of the known characteristic of the benchmark pulse at the time the benchmark pulse was transmitted by the surface pulse generator and $C_D$ is the value of the known characteristic of the benchmark pulse as measured by the downhole pulse sensor.

In some aspects, the known characteristic of the benchmark pulse is an amplitude of the benchmark pulse, a pressure of the benchmark pulse, or a change in pressure over a period of time.

In another aspect, the first processor is configured to compare the attenuation prediction factor to a lower attenuation threshold and, in response to determining that the attenuation prediction factor is less than the lower attenuation threshold (corresponding to a lesser degree of attenuation), configure the downhole pulse generator to transmit the set of one or more mud pulses at a decreased signal power.

In another aspect, the first processor is configured to compare the attenuation prediction factor to an upper attenuation threshold and, in response to determining that the attenuation prediction factor is greater than the upper attenuation threshold (corresponding to a greater degree of attenuation), configure the downhole pulse generator to transmit the set of one or more mud pulses at an increased signal power.

In some embodiments, the lower attenuation threshold and the upper attenuation threshold are equal. In some embodiments, the lower attenuation threshold is less than the upper attenuation threshold.

Another aspect provides a processor configured to determine a signal-to-noise ratio in response to the surface pulse sensor receiving at least one mud pulse of the set of one or more mud pulses from the downhole pulse generator. In some embodiments, the first processor makes this determination.

In some embodiments, a second processor is configured to compare the signal-to-noise ratio to a lower signal-to-noise threshold and, in response to determining that the signal-to-noise ratio is less than the lower signal-to-noise threshold, configure the downhole pulse generator to transmit the set of one or more mud pulses at an increased signal power.

In some embodiments, the second processor is configured to compare the signal-to-noise ratio to an upper signal-to-noise threshold and, in response to determining that the signal-to-noise ratio is greater than the upper signal-to-noise threshold, configure the downhole pulse generator to transmit the set of one or more mud pulses at a decreased signal power.

In some embodiments, the lower signal-to-noise threshold is in the range 1.5 to 3. Some aspects provide that the upper signal-to-noise threshold is in the range 3 to 4.

In some embodiments, the second processor is configured to cause the downhole pulse generator to refrain from transmitting the set of one or more mud pulses at a decreased signal power in response to determining that the signal-to-noise ratio is greater than the upper signal-to-noise threshold if the attenuation prediction factor is less than the upper attenuation threshold. In some aspects, the system is configured not to transmit the benchmark pulse if the signal-to-noise ratio is less than the upper signal-to-noise threshold.

In some aspects, transmitting the set of one or more mud pulses at a decreased signal power comprises transmitting the set of one or more mud pulses with a decreased amplitude, with a decreased pulse duration, and/or at an increased rate of data transmission.

In some aspects, transmitting the set of one or more mud pulses at an increased signal power comprises transmitting the set of one or more mud pulses with an increased amplitude, with an increased pulse duration, and/or at a decreased rate of data transmission.

In some aspects, the signal power is decreased proportionately to the ratio of the attenuation prediction factor to the upper attenuation threshold. In some aspects, the increase in the signal power is proportionate to the ratio of the attenuation prediction factor to the lower attenuation threshold.

In some aspects, the increase in the signal power is relative to a baseline value. In other aspects, the increase in the signal power is relative to the current signal power.

In some aspects, the system is configured to transmit a benchmark pulse with the surface pulse generator to the downhole pulse sensor during or shortly after a flow-off, when a drilling operation reaches a predetermined depth, and/or at a predetermined time.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

This invention provides various systems, methods and apparatus for mud pulse telemetry. In methods according to some embodiments of the invention, transmission of mud pulses encoding telemetry data is adjusted to account for expected signal degradation. In some embodiments benchmark pulses having known characteristics (such as amplitude or duration) are transmitted from a transmitter (which is located at the surface in some embodiments) to a pressure sensor or other pulse receiver (which may, for example, be located at the BHA). The known characteristics are detected by the pulse receiver. The measurements are applied to predict the likely degradation (e.g. due to pulse attenuation and/or dispersion) of downhole-to-surface mud pulse transmissions. Subsequent downhole-to-surface transmissions are adjusted to compensate for the attenuation and/or to obtain energy savings (and/or transmission rate increases) during low-attenuation conditions. Further refinements on these systems and methods, particularly concerning the use of signal-to-noise ratio measurements at the surface to more efficiently predict attenuation, are also disclosed.

Figure 1:
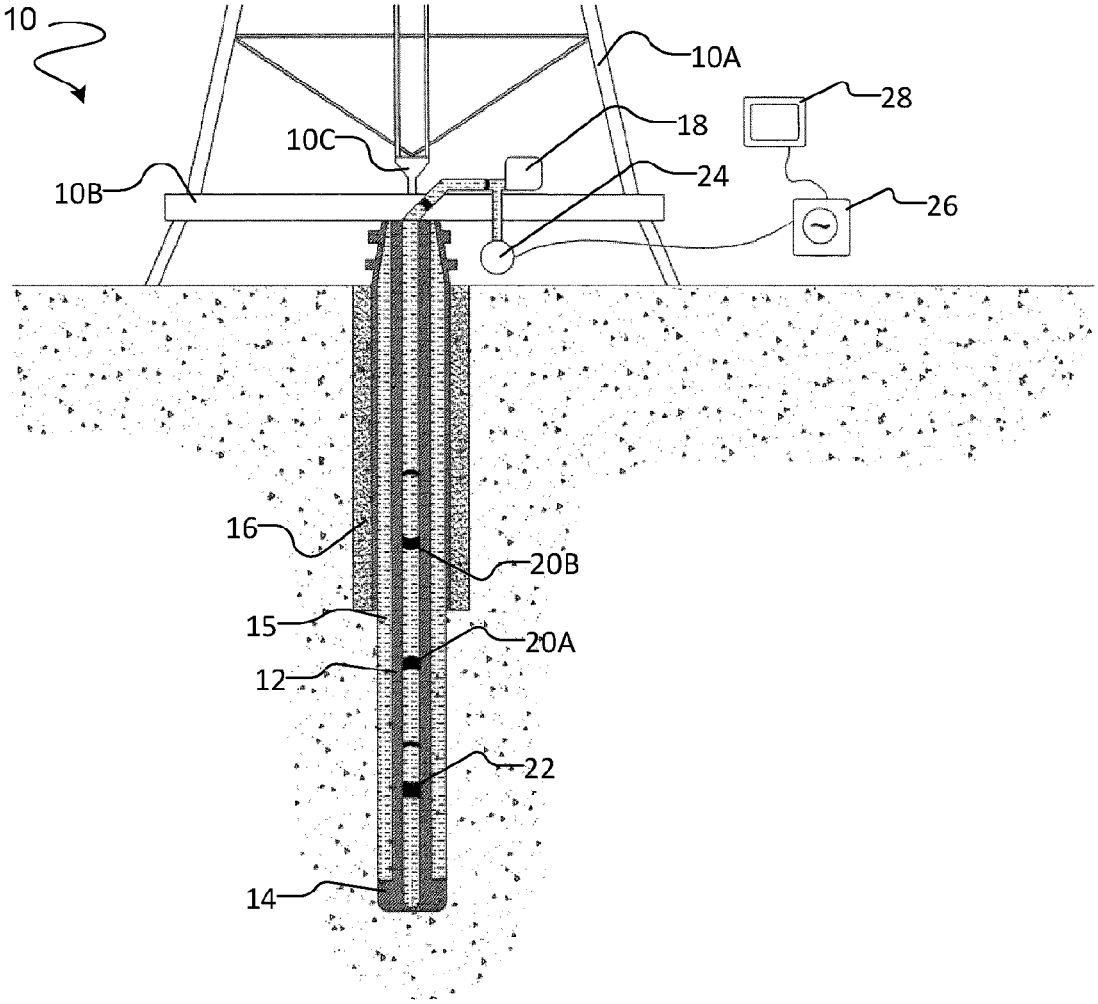
FIG. 1 is a schematic view of an example drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. The drill rig illustrated in FIG. 1 is an example only. The methods and systems described herein are not specific to any particular type of drill rig.

Drill string 12 may comprise a bottom hole assembly, as described above. The BHA may comprise probes that communicate data uphole by generating mud pulses which encode data; such pulses comprise uphole pulses 20A. The probe, in generating uphole pulses 20A, can control one or more characteristics of uphole pulses 20A—for example, the amplitude, pressure, and/or duration of uphole pulses 20A. The probe is configured to adjust one of more of the controllable characteristics of generated pulses to encode data in uphole pulses 20A.

Downhole MP telemetry apparatus 22 may, for example, generate uphole pulses 20A with, for example, one or more rotary valves or poppet valves or valves of another type that can be operated by telemetry apparatus 22 to temporarily restrict (including block) the flow of drilling fluid in the bore of drill string 12.

Uphole pulses 20A propagate uphole along drill string 12 and may be detected at a pressure sensor or other pulse receiver (e.g. pressure transducer 24) located along drill string 12 away from the BHA. For example, the receiver may be located at or near the earth surface.

At the surface, pressure transducer 24 detects the pressure of the drilling fluid in drill string 12 and/or in pipes (if any) connecting surface mud pulser 18 to drill string 12, and communicates these measurements to a processor 26. Processor 26 may, for example, be housed in a computer, a controller, or other apparatus. Processor 26 may be configured to process signals representing the detected uphole pulses 20A to extract the encoded telemetry data from the BHA. Processor 26 may optionally store and/or display one or more of these readings, or information based on one or more of these readings, on a display 28.

Uphole pulses 20A may be degraded as they propagate uphole. For example, the pulses 20A may be affected by attenuation and/or dispersion. If pulses 20A become too much attenuated then the pulses may not be distinguishable from noise by the time they reach the receiver. If pulses 20A are affected too much by dispersion then the pulses may spread until it becomes difficult or impossible to distinguish between adjacent pulses 20A at the receiver.

A system may be provided to evaluate and compensate for the degradation of uphole pulses 20A. In the illustrated embodiment, a surface mud pulser 18 generates pulses in the drilling fluid of drill string 12. Surface mud pulser 18 may comprise, for example, a hydraulic pulse valve that receives drilling fluid from one or more surface pumps, which the hydraulic pulse valve then sends down drill string 12. Surface mud pulser 18 may take a variety of other forms, including rotors, flow restrictors, pumps, modulators, or any other apparatus capable of inducing vibrations or variable rates of flow in the drilling fluid in drill string 12. Such vibrations or variations in flow are referred to herein as downhole pulses 20B. Uphole pulses 20A and downhole pulses 20B are collectively referred to herein as mud pulses 20.

In some embodiments, surface mud pulser 18 is located in the drill string near to the surface. In such embodiments, surface mud pulser 18 may comprise, for example, a sub coupled into the drill string that comprises a pulse generation valve operable to transmit pulses that can be used to characterize the attenuation of mud pulses 20 as they propagate along the drill string.

Surface mud pulser 18 may optionally be controlled directly or indirectly by processor 26. In some embodiments, processor 26 may configure surface mud pulser 18 to send certain downhole pulses 20B in response to receiving readings from pressure transducer 24.

Surface mud pulser 18 sends downhole pulses 20B which propagate along drill string 12 to downhole MP telemetry apparatus 22. Downhole MP telemetry apparatus 22 may comprise, for example, a telemetry probe contained in a BHA. Downhole MP telemetry apparatus 22 comprises a mud pulse detector capable of detecting downhole pulses 20B sent to it by surface mud pulser 18. The mud pulse detector may comprise, for example, a pressure sensor.

Signals representing downhole pulses 20B are analyzed (the location at which the analysis is performed may be different in different embodiments) to evaluate the degradation of downhole pulses 20B. Since downhole pulses 20B are travelling along the same path as uphole pulses 20A, it is a fair assumption that the degradation of uphole pulses 20A will be related to the degradation of downhole pulses 20B. Downhole MP telemetry apparatus 22 is then configured to adjust the transmission parameters of uphole pulses 20A to counteract the expected degradation of uphole pulses 20A.

Figure 2A:
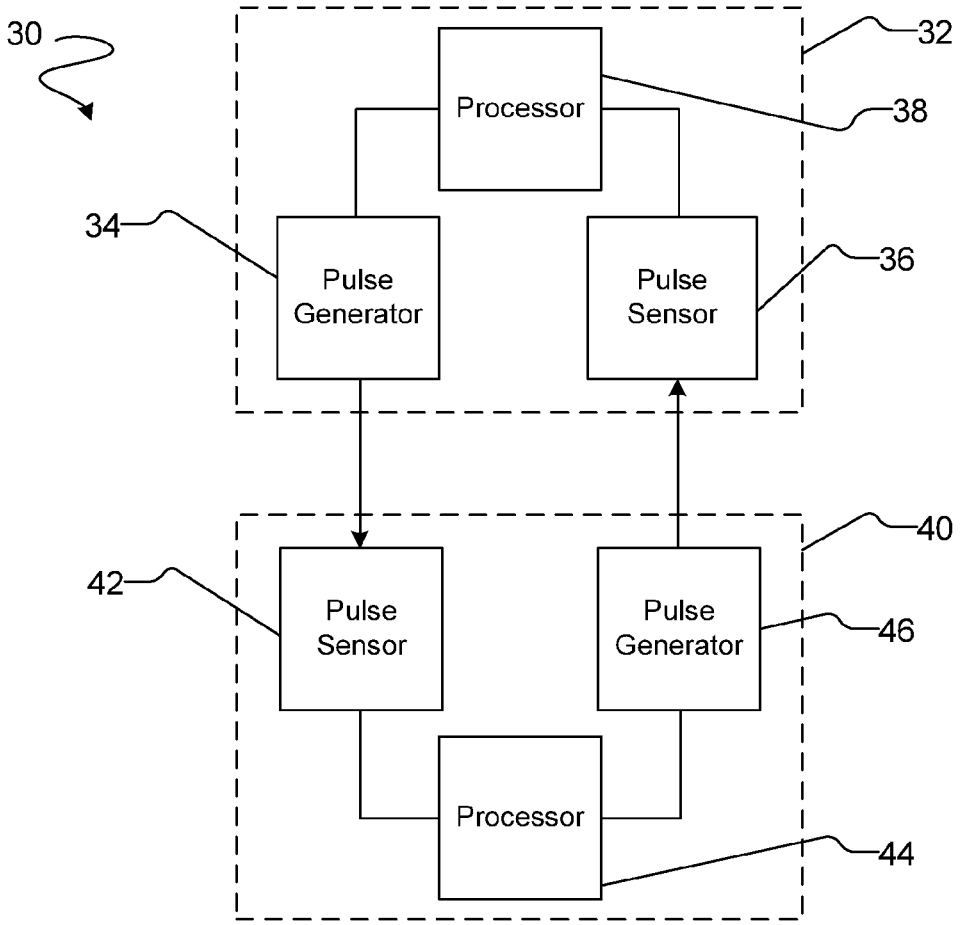
FIG. 2A is a schematic diagram of an example mud pulse telemetry system.

FIG. 2A depicts an example telemetry system 30. Surface system 32 comprises a surface pulse generator 34, a surface pulse sensor 36, and a surface processor 38. Surface processor 38 is in communication with each of surface pulse generator 34 and surface pulse sensor 36. Surface pulse generator 34 generates mud pulses 20B which are transmitted downhole to downhole system 40. Mud pulses 20B are received at downhole pulse sensor 42. Downhole pulse sensor 42 is in communication with downhole processor 44, which receives from downhole pulse sensor 42 sensor readings associated with downhole pulses 20B. Downhole processor 44 is also in communication with downhole pulse generator 46.

Downhole pulse generator 46 generates uphole pulses 20A that travel through drill string 12 to surface system 32, and in particular to surface pulse sensor 36. Surface pulse sensor 36 and downhole pulse sensor 42 may have the same or different implementations. Similarly, surface pulse generator 34 and downhole pulse generator 46 may be implemented using similar or different apparatus. For example, surface pulse generator 34 may comprise a hydraulic pulse valve, whereas downhole pulse generator 46 may comprise a rotary valve.

In operation, surface processor 38 instructs surface pulse generator 34 to generate a downhole mud pulse 20B with one or more known characteristics. Characteristics of mud pulses 20 include amplitude and duration, and may include any other attribute of a mud pulse 20 that can be detected by downhole pulse sensor 42. A mud pulse 20 with a known characteristic that has been selected for the purpose of enabling telemetry system 30 to detect or predict the attenuation of mud pulse signals is referred to herein as a "benchmark pulse". The known characteristic of a benchmark pulse may be known both by surface system 32 and downhole system 40, or may be known just by surface system 32.

In some embodiments where the known characteristic of the benchmark pulse is known by surface system 32, surface system 32 generates the benchmark pulse with a known value of the characteristic based on a value stored in or accessible to surface system 32. In other embodiments where the known characteristic of the benchmark pulse is known by surface system 32, surface system 32 does not know the value of the characteristic prior to generating the benchmark pulse; in some such embodiments, surface system 32 detects the value of the characteristic at a place or time near to where the benchmark pulse was generated.

In some embodiments, the known characteristic of the benchmark pulse is known by downhole system 40 due to pre-arrangement—e.g. by configuring downhole processor 44 and/or a memory in communication with downhole processor 44 to store the value of the known characteristic prior to the use of downhole system 40. Alternatively, or in addition, the known characteristic of the benchmark pulse may be known by downhole system 40 due to communication with surface system 32. For example, surface system 32 may communicate the value of the known characteristic via downlink telemetry (e.g. via MP telemetry, EM telemetry, variation of drilling parameters, or the like) to downhole system 40.

The known characteristic of a benchmark pulse may comprise, for example, one or more of an amplitude of the pulse, an energy of the pulse, a duration of the pulse or a "time of flight" (otherwise referred to as a "slope-based" measure). In a time of flight approach, surface system 32 generates a mud pulse of known duration with a known peak amplitude. For example, surface system 32 may generate a mud pulse for 10 seconds at maximum amplitude and then stop. Downhole system 40 may then detect the rate of pressure increase over the time during which the pulse is being received (i.e. over the 10 second interval). Such a pulse may be easier or more reliable to detect than a shorter pulse of known amplitude.

A characteristic that is "known" comprises a characteristic type (e.g. amplitude, energy duration, or time of flight) and an associated value (or values). The value associated with the characteristic may change over the course of transmission; for example, the amplitude of a mud pulse may decrease as it travels down drill string 12. Indeed, such behaviour is expected as the typical consequence of attenuation. Telemetry system 30 measures the degradation of downhole pulse 20B by comparing the value of a known characteristic measured at downhole system 40 to the original value of that characteristic as measured or generated by surface system 32. Telemetry system 30 then predicts the degradation of uphole pulses 20A on the basis that degradation of uphole pulses 20A is likely to be proportionate to the degradation experienced by downhole pulses 20A. In some embodiments, telemetry system 30 compares multiple benchmark pulses to corresponding benchmark pulse values (which may be the same or different from different benchmark pulses) to predict pulse degradation.

In some embodiments, downhole processor 44 receives a sensor reading from downhole pulse sensor 42 corresponding to a benchmark pulse. Downhole processor 44 then instructs downhole pulse generator 46 to transmit that sensor reading as data via MP telemetry or another type of telemetry to surface system 32. For example, in an embodiment where the benchmark pulse has a known amplitude, downhole pulse sensor 42 measures the amplitude of the benchmark pulse and downhole pulse generator 46 transmits that amplitude as data encoded in an MP telemetry signal (or a telemetry signal on an alternative telemetry system). Surface system 32 may then receive an MP telemetry signal from downhole system 40 (for example, by detecting pressure in the drilling fluid at surface pulse sensor 36) and present these readings to a user and/or transmit instructions to downhole system 40 to vary its transmission settings.

In some embodiments, surface processor 38 automatically determines new transmission settings for downhole system 40 in response to receiving an MP telemetry signal encoding a sensor reading of a benchmark pulse from downhole system 40. Instructions generated by surface processor 38 may be transmitted to downhole system 40 through any available method, including through MP telemetry (using surface pulse generator 34), EM telemetry, variation of drilling parameters or any other telemetry method available to the system.

In another embodiment, downhole system 40 determines automatically whether any adjustments to its transmission need to be made without the need for downlinked instructions. Adjustments made by downhole system may be a function of the degradation of benchmark pulses as measured by downhole system 40. For example, if a benchmark pulse is received at downhole pulse sensor 42 with significant attenuation (e.g. significantly reduced amplitude or duration) then downhole processor 44 may instruct downhole pulse generator 46 to generate subsequent uphole pulses 20A with greater amplitude or duration so as to increase the likelihood of successful reception by surface pulse sensor 36.

Downhole system 40 must know or be able to access the value of the benchmark pulse's known characteristic(s) in order to make such automatic determinations. In such embodiments, values of known characteristics of each benchmark pulse may be predetermined and stored in a memory accessible by downhole processor 44. Additionally, or in the alternative, values of known characteristics of benchmark pulses may be communicated to downhole system 40 by, for example, surface system 32. Communication of values of known characteristics of benchmark pulses may be performed by telemetry system 30 using MP telemetry, EM telemetry, variation of drilling parameters, or any other method of communication with downhole system 40 that is available.

In some embodiments, the value of the known characteristic of the benchmark pulse may be encoded in a benchmark pulse, or in a series of benchmark pulses. For example, transmission of a single benchmark pulse may indicate that the benchmark pulse was generated with a high amplitude (e.g. the maximum amplitude within a predetermined range). In this example, two benchmark pulses transmitted in succession, or within a certain period of time, may indicate that the benchmark pulses were generated with a medium-intensity amplitude (e.g. the median amplitude within a predetermined range). Three benchmark pulses transmitted in succession, or within a certain period of time, may indicate that the benchmark pulses were generated with low amplitude (e.g. the minimum amplitude within a predetermined range).

In other embodiments, other patterns or characteristics of benchmark pulses may be used to encode the value of the known characteristic of a benchmark pulse. For example, the value of the known characteristic of the benchmark pulse may be communicated to downhole system 40 via downhole pulses 20B which encode the value of the known characteristic of a benchmark pulse as binary data. In some embodiments, such transmissions may be analogous to the transmissions by which downhole system 40 communicates telemetry data uphole to surface system 32.

In some embodiments, benchmark pulses may comprise part of a series of downhole pulses 20B which encode telemetry data other than, or in addition to, data regarding the value of a known characteristic of the benchmark pulses. In other embodiments, benchmark pulses may not be part of the standard data-transmission protocol of an MP telemetry system.

In order to respond to a benchmark pulse, downhole system 40 is preferably able to determine which of the pulses generated by surface system 32 are benchmark pulses so as to transmit measurement data to the surface and/or to act on measurement data automatically. Although it may be possible in some implementations of telemetry system 30 for every pulse generated by surface system 32 to possess the known characteristic in question, it is often advantageous to generate benchmark pulses only periodically, as the benchmark pulse characteristics may not be desirable for a given set of drilling or telemetry conditions.

Benchmark pulses may be generated at set time intervals (e.g. every five minutes or every hour), although this approach requires reliable time keeping and synchronization between surface system 32 and downhole system 40. In some embodiments, benchmark pulses are preceded by a transmission from surface system 32 to downhole system 40; this transmission may be via MP telemetry or via another method of telemetry.

In some embodiments, generation of benchmark pulses is event-based; for example, surface system 32 may generate a benchmark pulse after flow-offs. Flow-offs are interruptions of the flow of drilling fluid in drill string 12, typically for the purpose of maintenance, such as the adding of a new section of drilling pipe to drill string 12. Downhole system 40 may recognize that the flow-off has begun (e.g. by detecting the cessation of fluid flow via a flow switch) and prime itself for receipt of a benchmark pulse when the flow-off ends, i.e. when a flow-on occurs. A benchmark pulse sent immediately after and/or a set time after a flow-off ends (i.e. at and/or shortly after a flow-on) may be more easily detected by at least some embodiments of downhole system 40. In this way, less transmission bandwidth (or even no transmission bandwidth) is lost to benchmark pulses. Further, such embodiments may reduce the impact of noise generated by mud pulser 18, which may be less pronounced immediately after and/or shortly after a flow-off.

In some embodiments, benchmark pulses are generated after a certain amount of drilling has been done. For example, a benchmark pulse may be generated once every few meters of drilling (for example, after every 7.5 meters (approximately 25 feet) of drilling). Pulse attenuation changes according to many factors, but in many drilling scenarios one of the major factors affecting attenuation is the depth of the borehole. Accordingly, it is sometimes advantageous to generate benchmark pulses at regular depth intervals to detect corresponding changes in attenuation.

In embodiments where flow-off conditions occur at regular depth intervals (e.g. 9 meters, or approximately 30 feet), the depth-based approach may be combined with the flow-off condition approach. This is particularly useful when drill pipe segments are not unsuitably long; for example, if drill pipe segments are 9 meters long, then a flow-off condition will likely occur every 9 meters to add a new section of drill pipe. This provides a convenient opportunity to generate a benchmark pulse every 9 meters without significantly impacting drilling performance. If, however, drill pipe segments are longer than the interval at which of benchmark pulses are preferred to be generated, then it is sometimes advantageous to generate benchmark pulses more frequently, such as in intervals of 1 meter (3 feet) to 10 meters (30 feet), for example about every 1.5 meters (approximately 5 feet).

For example, it may sometimes be preferable to generate benchmark pulses relatively frequently (e.g. at 1.5-meter intervals) if multiple drill sites with similar operational envelopes (i.e. expected formation distribution) are being drilled. Relatively frequent attenuation measurements may enable an operator to "map" a borehole's attenuation. Obtaining more samples of mud pulse attenuation at one location may enable an operator to make an informed estimate of initial drilling and/or telemetry parameters at nearby and/or similar drill sites.

Additionally, or alternatively, benchmark pulses may be coded so as to make benchmark pulses more distinguishable from noise generated by the operation of, for example, mud pulser 18. Such coding may, for example, comprise sending benchmark pulses in identifiable patterns, such as sending three two-second benchmark pulses at three-second intervals (i.e. with a one second gap between pulses).

Telemetry system 30 uses the measurements of benchmark pulses collected by downhole system 40 to predict attenuation of MP telemetry signals in drill string 12; methods for obtaining such predictions are discussed in further detail below. Once telemetry system 30 has obtained a prediction of attenuation, the telemetry parameters of downhole system 40 may be changed to increase or decrease the energy per bit of data transmitted from downhole system 40 to the surface, and/or to increase or decrease the rate of transmission. The energy per bit of data transmitted can be increased by, for example, increasing the amplitude of mud pulses 20 sent by downhole system 40. The rate of transmission can be increased by, for example, decreasing the duration of mud pulses 20. Decreases in the energy per bit or rate of transmission can be effected by the reverse operations. For the purposes of this disclosure, and to avoid unnecessary repetition, the energy per bit of data transmission is included in the term "signal power".

Downhole pulse generator 46 may increase the amplitude of mud pulse 20 by, for example, further restricting the flow of drilling fluid through a valve (in a positive-pressure telemetry system) or by opening a valve wider (in a negative-pressure telemetry system) or by more suddenly restricting flow or by restricting flow for longer periods of time. Increasing or decreasing the duration of mud pulses 20 may, for example, be effected by restricting or facilitating flow of drilling fluid for longer or shorter periods of time.

Figure 2B:
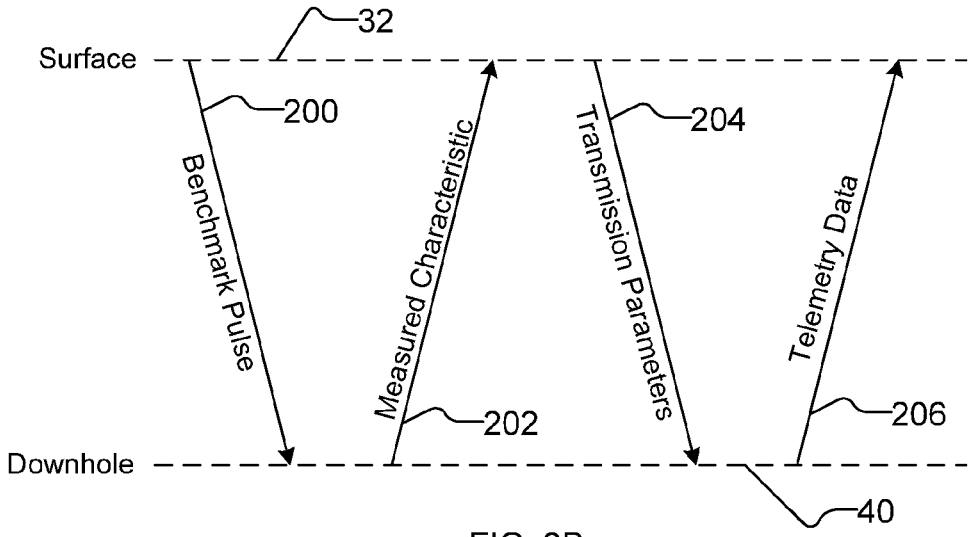
FIG. 2B is an example graph of telemetry transmissions.

FIG. 2B is an example graph of telemetry transmissions between surface system 32 and downhole system 40. Surface system 32 transmits a first transmission 200 to downhole system 40. The first transmission 200 is a downhole pulse 20B with a known characteristic (as described further below). The known characteristic is measured at downhole system 40. In the illustrated embodiment, downhole system 40 transmits to surface system 32 a second transmission 202 encoding a measurement of that known characteristic taken by downhole system 40. Surface system 32 then transmits a third transmission 204 to downhole system 40 encoding transmission parameters for downhole system 40. Downhole system 40 then transmits to surface system 32 a fourth transmission 206 comprising uphole pulses 20B encoding telemetry data.

As will be discussed further below, some embodiments may comprise fewer than all of the transmissions depicted in FIG. 2B. For example, in an embodiment where downhole system 40 adjusts its transmission parameters in response to measuring the known characteristic of the benchmark pulse, second transmission 202 and third transmission 204 may be omitted.

Figure 3A:
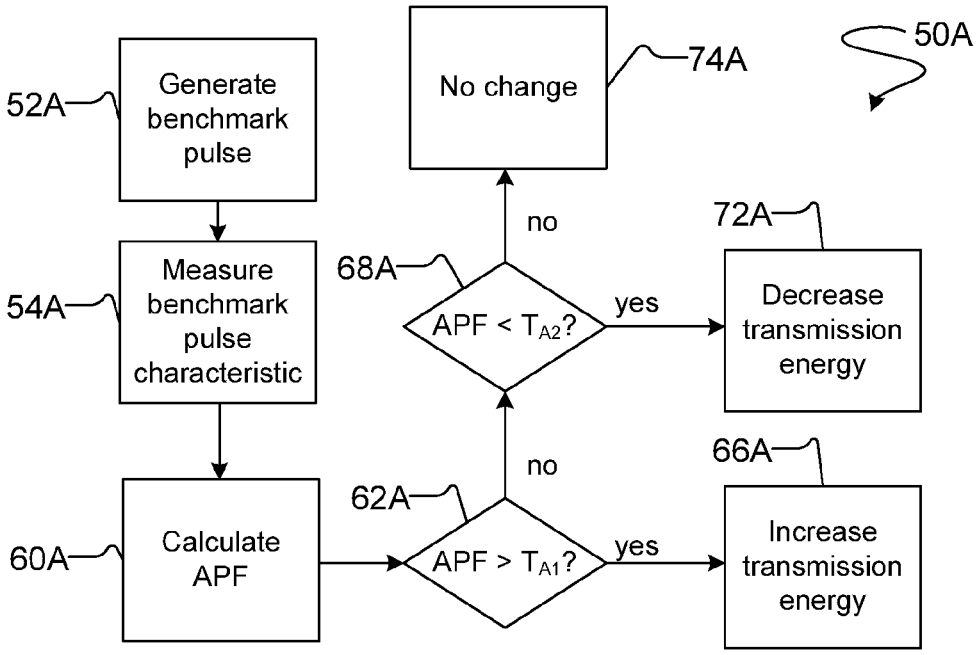
FIG. 3A is a block diagram of an example attenuation prediction method.
Figure 3B:
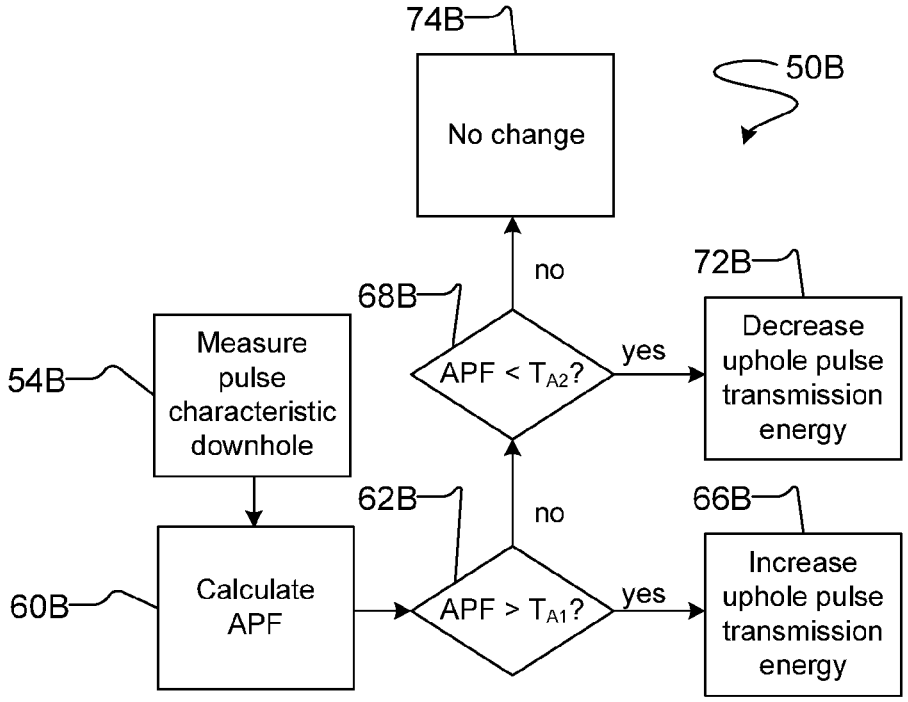
FIG. 3B is a block diagram of an example downhole attenuation prediction method.
Figure 3C:
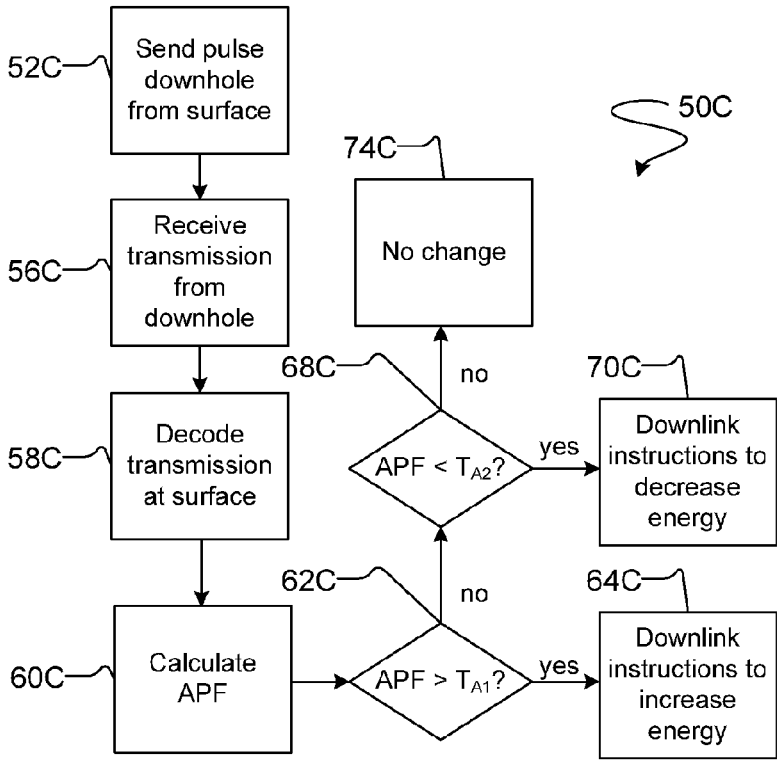
FIG. 3C is a block diagram of an example surface attenuation prediction method.

FIGS. 3A, 3B and 3C (collectively FIG. 3) depict a block diagram of an example pulse degradation prediction method 50A, an example downhole pulse degradation prediction method 50B, and an example surface pulse degradation prediction method 50C.

FIG. 3A depicts a method performed by telemetry system 30; FIG. 3B depicts a method performed by downhole system 40; FIG. 3C depicts a method performed by surface system 32. In FIGS. 3A to 3C, like reference numerals indicate like elements, and like numerals may be referred to together (e.g. "block 52" refers to block 52A and block 52C collectively). For example, at block 60A, telemetry system 30 calculates an attenuation prediction factor (discussed further below); at block 60B, downhole system 40 calculates an attenuation prediction factor; and at block 60C, surface system 40 calculates an attenuation prediction factor.

At block 52, surface system 32 transmits a benchmark pulse to downhole system 40. At block 54, downhole system 40 measures the benchmark pulse's known characteristic using downhole pulse sensor 42. In some embodiments, after downhole system 40 measures the benchmark pulse's known characteristic, downhole processor 44 receives the sensor reading from downhole pulse sensor 42 and instructs downhole pulse generator 46 to communicate the measurement of said characteristic to surface system 32. At block 56C, surface pulse sensor 36 receives the transmission from downhole pulse generator 46. At block 58C, the received signal is then decoded by surface system 32; this may, in some embodiments, be performed by surface processor 38 or, in other embodiments, may be performed by a separate decoder/demodulator controller in communication with surface pulse sensor 36 and/or surface processor 38. Either way, surface processor 38 ultimately receives the decoded transmission.

Then, at block 60, telemetry system 30 calculates an attenuation prediction factor (APF). In some embodiments, block 60 comprises block 60B, in which downhole processor 44 calculates APF. In other embodiments, block 60 comprises block 60C, in which surface processor 38 calculates APF. APF provides a measure of the attenuation of a signal received at downhole system 40. As described above, attenuation of downhole pulses 20B can be measured based on the attenuation of one or more characteristics—for example, an amplitude of a benchmark pulse or a rate of change in the amplitude of the amplitude of a benchmark pulse.

In some embodiments, APF is a proportionate measure of attenuation. That is, APF may reflect the proportion of the value of the known characteristic of a benchmark pulse that was lost due to attenuation. In other embodiments, APF provides an estimate of the degree to which an uphole pulse 20A would need to varied (e.g. by having its amplitude increased) to overcome the measured attenuation. If the relationship between the measured attenuation of a characteristic and the signal power of a mud pulse 20 is linear, these two approaches may be similar or identical.

If, for example, a characteristic tends to vary non-linearly with the attenuation of the signal (e.g. if a ½ reduction in the characteristic's value reflects a ¼ reduction in signal power and a ¼ reduction in the characteristic's value reflects a 1/16 reduction in signal power), then the formula for calculating APF may be adapted to better predict attenuation based on that characteristic (e.g. by making APF proportionate to the square of the measured attenuation).

APF can, for example, be calculated in the following way:

$$APF = \frac{C_S - C_D}{C_S}$$

where $C_S$ is the value of the known characteristic of the benchmark pulse at the time it was generated (i.e. at surface pulse generator 34) and $C_D$ is the value of that characteristic at the time it was measured by downhole system 40 (i.e. at downhole pulse sensor 42). This is an example of a normalized measure of attenuation.

As another example, APF can be calculated in the following way:

$$\mathrm{APF}=C_D-C_S$$

where $C_S$ and $C_D$ have the above meanings. This alternative calculation provides a measure of the drop in the value of the characteristic between surface system 32 and downhole system 40. This is an example of an absolute measure of attenuation.

At block 62, telemetry system 30 determines whether APF is greater than a first threshold, $T_{A1}$. Block 62 may comprise block 62B, in which downhole processor 44 determines whether APF is greater than $T_{A1}$. Block 62 may alternatively, or in addition, comprise block 62C, in which surface processor 38 determines whether APF is greater than $T_{A1}$. $T_{A1}$ is an "upper bound" for signal attenuation. If APF is greater than $T_{A1}$, then this may be taken as an indication that attenuation is significant. The value of thresholds such as $T_{A1}$ may vary based on the equation used to calculate attenuation. For example, an embodiment using a normalized measure of attenuation might set $T_{A1}$ to be ½, whereas an embodiment using an absolute measure of attenuation might set $T_{A1}$ to be 50 kPa.

In some embodiments, if APF is greater than $T_{A1}$, then method 50 continues on to block 64C, where surface system 32 instructs one or more telemetry systems to transmit to downhole system 40 instructions to vary the transmission parameters of downhole system 40. The transmitted instructions instruct downhole system 40 to increase the energy of its transmissions (e.g. by increasing the amplitude of uphole pulses 20A). In some embodiments, downhole system 40 may alternatively or in addition be instructed to decrease its rate of transmission (e.g. by increasing the duration of uphole pulses 20A and/or the separation between uphole pulses 20A).

At block 66, downhole processor 44 either acts on the transmitted instructions or, in response to determining that APF is greater than $T_{A1}$, independently acts to increase the energy or decrease the rate of transmission of uphole pulses 20A subsequently transmitted by downhole pulse generator 46.

It may not be possible for downhole system 40 to increase the energy or decrease the rate of transmission of uphole pulses 20A beyond its current transmission parameters. Surface system 32 may recognize this circumstance and, instead of downlinking instructions, surface system 32 may alert a user. Surface system 32 may also, or alternatively, automatically act on this information by switching over to another telemetry mode (such as EM telemetry) and/or deactivating MP telemetry. In some embodiments, surface system 32 may downlink instructions to downhole system 40 and downhole system 40 may, in response, communicate to surface system 32 via a telemetry method that the instructions cannot be carried out.

If APF is not greater than $T_{A1}$, then method 50 continues to block 68. At block 68, telemetry system 30 determines whether APF is less than a second threshold $T_{A2}$. Block 68 may comprise block 68B, in which downhole processor 44 determines whether APF is less than a second threshold $T_{A2}$. Block 68 may alternatively, or in addition, comprise block 68C, in which surface processor 38 determines whether APF is less than a second threshold $T_{A2}$. $T_{A2}$ is a "lower bound" for attenuation. If APF is less than $T_{A2}$, then attenuation may be regarded as sufficiently low that downhole system 40 could increase the transmission rate and/or reduce energy-per-bit of transmissions while still enabling surface system 32 to successfully receive and decode those transmissions.

In some embodiments, if APF is less than $T_{A2}$, then method 50C continues to block 70C, where surface processor 38 instructs an available telemetry system to send instructions to downhole system 40 instructing it to decrease the energy of its transmissions.

At block 72, downhole processor 44 either acts on transmitted instructions from surface system 32 or, in response to downhole processor 44 determining that APF is greater than $T_{A1}$, independently acts to decrease the energy and/or increase the rate of transmission of uphole pulses 20A subsequently transmitted by downhole pulse generator 46. This may be effected by, for example, decreasing the amplitude of mud pulses 20 sent to surface system 32. Alternatively, or in addition, downhole system 40 may increase its transmission rate (e.g. by decreasing the duration of each mud pulse 20 and/or the duration between mud pulses 20). In some embodiments, downhole system 40 may both decrease the amplitude of its mud pulses 20 and decrease the duration of mud pulses 20, or may do only one of these.

In some embodiments, decreasing the duration of mud pulses 20 does not decrease the energy usage of downhole system 40; such embodiments are still advantageous, as the rate of transmission may be increased. For the purposes of this disclosure, and to avoid unnecessary repetition, unless otherwise stated or necessarily implied, increasing or decreasing the rate of transmission will be deemed to be included in references to decreasing or increasing signal power, respectively.

If, in block 68, APF is not less than $T_{A2}$, then method 50 continues on to block 74, where no change is undertaken. In this event, APF is within the range of acceptable operation, as defined by the upper and lower bounds $T_{A1}$ and $T_{A2}$, and transmission may continue unchanged.

The degree to which downhole system 40 varies its transmission parameters is, in some embodiments, dependent on the value of APF. In some embodiments, the variation of the parameters of downhole system 40 is proportionate to the ratio between APF and the threshold with which it is being compared. For example, if APF is 80% of $T_{A2}$, then downhole system 40 may increase the amplitude of its transmissions by 25%. Such an increase can be expected to reduce perceived attenuation of uphole pulses 20A as detected by surface system 32 such that subsequent transmissions can be expected to have an perceived attenuation roughly equivalent to $T_{A2}$. Corresponding adjustments can be made when APF is less than $T_{A1}$.

In this context, "perceived attenuation" means the attenuation of the received uphole pulses 20A relative to a previous set of pulse characteristics (e.g. the characteristics of mud pulses generated by downhole system 40 according to its original transmission parameters). For example, if downhole system 40 initially transmitted uphole pulses 20A with an amplitude x and now transmits uphole pulses 20A with an amplitude 2x with a total attenuation of 50%, then the perceived attenuation of the uphole pulse would be 0—i.e. the amplitude of the uphole pulse 20A at the surface would be equal to the amplitude of an uphole pulse 20A transmitted with downhole system 40's original transmission parameters and received without any attenuation.

$T_{A1}$ and $T_{A2}$ may, for example, be set to the same value. In an embodiment where APF varies between 0 and 1, both thresholds may be set to 0.5. If APF increases to, for example, 0.6, then downhole system 40 may be instructed to increase its transmission amplitude or duration by 25% over the baseline. In an embodiment where adjustments to downhole system 40's transmission parameters are made relative to the value of APF, the net result of setting $T_{A1}$ and $T_{A2}$ in this way may be that the perceived attenuation of uphole pulses 20A will be increased or reduced towards 50% each time method 50 is performed. As another example, $T_{A1}$ and $T_{A2}$ may be set to different values, such as 0.8 and 0.3, respectively.

In some embodiments, if the newly calculated transmission parameters are not substantially different from the previous transmission parameters, then surface system 32 may not send instructions to downhole system 40 so as to avoid the cost of downlinking.

In some embodiments, adjustments to the transmission parameters of downhole system 40 are made from a baseline value. In such embodiments, downhole system 40 may initially transmit mud pulses 20 at a known baseline amplitude and/or duration. As attenuation of benchmark pulses increases or decreases, proportionate variations are made to the transmission parameters of downhole system 40 relative to the baseline values. In this way, the value of the known characteristic of successive benchmark pulses does not necessarily need to be varied over time.

For example, if attenuation of a first benchmark pulse is measured to be 40% of the surface value of the known characteristic, then the transmission parameters of downhole system 40 may be increased by 67% from the baseline to compensate for the expected attenuation of subsequent uphole pulses 20A. If a second, later benchmark pulse is measured to have an attenuation of 50%, then the transmission parameters of downhole system 40 may be increased by 100% from the baseline to compensate for the expected attenuation of subsequent uphole pulses 20A. Using this baseline approach, it may not be necessary to change the values of known characteristics of benchmark pulses.

In some embodiments, downhole system 40 automatically calculates variations in its transmission parameters. In such an embodiment, the example attenuation prediction method 50 of FIG. 3 may be modified to omit blocks 56, 58, 64, and 70. Blocks 60, 62 and 68 would then be performed by downhole processor 44.

In some embodiments, surface system 32 may change the values of known characteristics of benchmark pulses used for calculating APF. If downhole system 40 stores these values for comparison by downhole processor 44, surface system 32 may communicate these new values to downhole system 40 in its instructions in blocks 64 and 70, or at other times. In such embodiments, if the characteristics of benchmark pulses are changed over time so as to generally correspond to the parameters use by downhole pulse generator 46, then variations in downhole system 40's transmission parameters may be calculated relative to the current values of those parameters, instead of (or in addition to) a baseline value.

By measuring the attenuation of signals generated at surface system 32 and received by downhole system 40, the system may attain, via simple pressure measurement, an indication of aggregate bore conditions resulting from factors such as depth, density, fluid pulse speed, and pressure drop across a drill string 12. Such measurements allow telemetry system 30 to improve its prediction of signal degradation in downhole-to-surface transmissions. It is possible to further enhance this improvement to downhole telemetry systems and methods by making use of information collected from signals generated by downhole system 40 and received at surface system 32.

One such refinement to the previously disclosed systems and methods is the calculation of the signal-to-noise ratio (SNR) at the surface pulse sensor 36. As will be seen, these two approaches (attenuation prediction and signal-to-noise measurement) may be used together such that, in some circumstances, their interaction may further improve the efficiency of mud pulse telemetry beyond the gains obtained by either method in isolation.

FIGS. 4A, 4B, 4C and 4D (collectively FIG. 4) show example graphs depicting signals 82 and 82' and noise 84 and 84'. Signals 82 and 82' are mud pulse transmissions from downhole system 40 and received at surface system 32. The vertical axes of both graphs denote sensor readings of MP telemetry signals (e.g. pressure), as detected by surface pulse sensor 36. The horizontal axes denote time. Bounding lines 86 and 86' visually depict the amplitude of signals 82 and 82', respectively. Bounding lines 88 and 88' correspondingly indicate the amplitude of noise 84 and 84'. In this depiction amplitude is being measured using a peak-to-peak method, but other methods of measuring amplitudes (such as averaging, root mean square or the like) may also be used.

Using this or other information, a surface system 32 (and, in some embodiments, particularly a surface processor 38) may calculate the SNR using any method for calculating SNR known to the art or later discovered. Determining SNR may comprise dividing a characteristic of the measured signal by a corresponding characteristic of the noise. For example, the SNR may be calculated by dividing the amplitude of signal 82 by the amplitude of noise 84 and squaring the result.

A given telemetry system will generally have an ideal range for the SNR to lie within in order to strike an optimal balance between maximizing transmission rate, minimizing energy expenditure, and ensuring adequate reception of the signal. In many systems, it is desirable for the signal to be at least twice as powerful as the noise (i.e. SNR greater than two), and it is often not necessary to obtain an SNR in excess of three or four to ensure adequate reception. These ranges are examples only, and may vary according to project needs and the capabilities of the available hardware. For example, some embodiments can receive and decode signals with an SNR as low as 1.

Figure 4A:
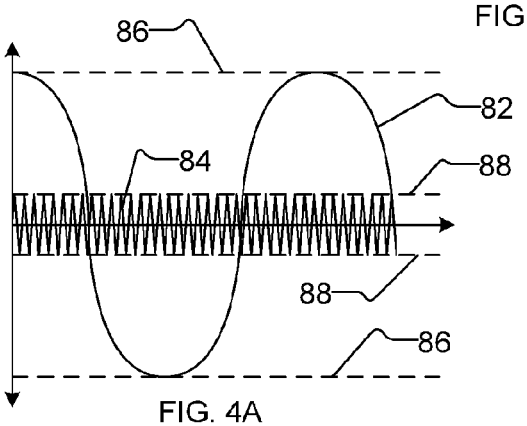
FIG. 4A is an example graph depicting signal and noise with a high signal-to-noise ratio.
Figure 4B:
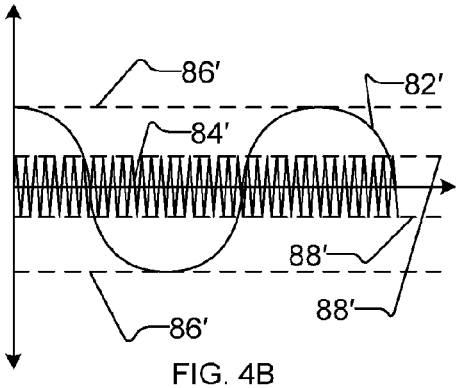
FIG. 4B is an example graph depicting signal and noise with a low signal-to-noise ratio.
Figure 4C:
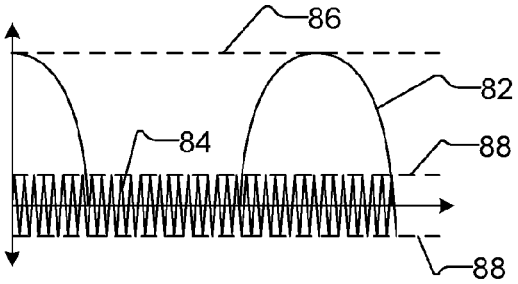
FIG. 4C is an example graph depicting positive-amplitude signal and noise with a high signal-to-noise ratio.
Figure 4D:
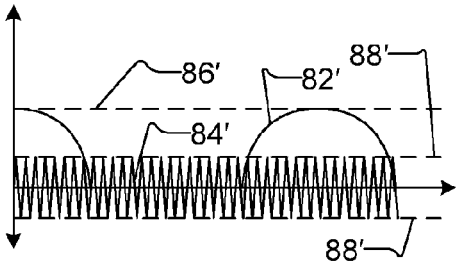
FIG. 4D is an example graph depicting positive-amplitude signal and noise with a low signal-to-noise ratio.

FIGS. 4A and 4C show graphs depicting signals with relatively high SNR (e.g. an SNR of 5). FIG. 4A shows a signal with both positive- and negative-pressure pulses, whereas FIG. 4C shows a signal with only positive-pressure pulses. FIGS. 4B and 4D show graphs depicting signals with lower SNR (e.g. an SNR of 2.5). FIG. 4B shows a signal with both positive- and negative-pressure pulses, whereas FIG. 4D shows a signal with only positive-pressure pulses. Some embodiments may provide signals with only negative-pressure pulses (not shown).

Figure 5:
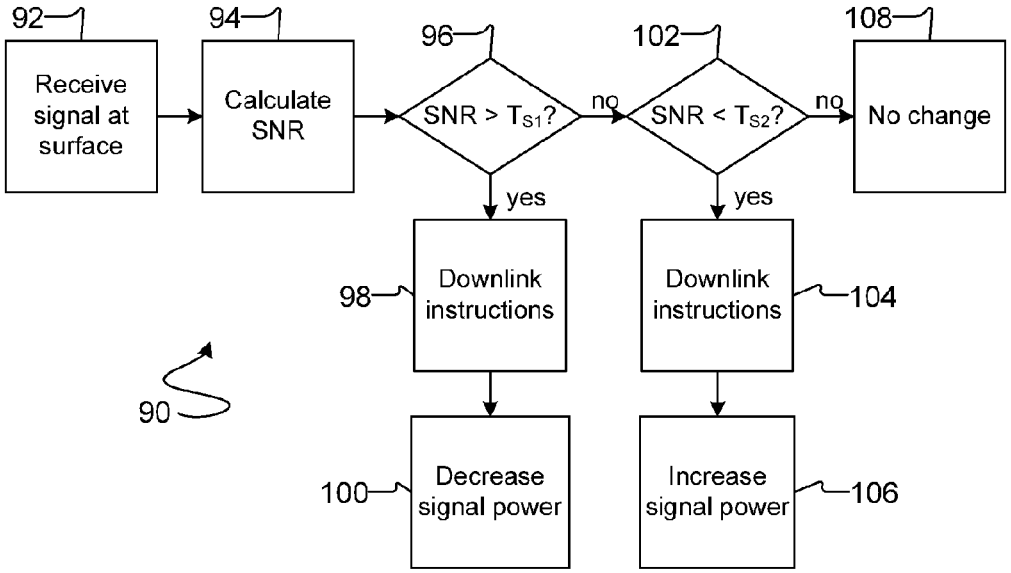
FIG. 5 is a block diagram of an example signal-to-noise adjustment method.

FIG. 5 shows an example signal-to-noise adjustment method 90. At block 92, surface system 32 receives a signal from downhole system 40. Method 90 then goes to block 94, where surface system 32 calculates the SNR based on its measurements of that system. Method 90 moves on to block 96, where surface system 32 determines whether the SNR is greater than a threshold $T_{S1}$. If the SNR is greater than $T_{S1}$, method 90 proceeds to block 98, where surface system 32 transmits instructions to downhole system 40. The instructions instruct downhole system 40 to decrease its signal power. Method 90 then goes on to block 100, where downhole system 40 acts on those instructions by, for example, decreasing the amplitude of mud pulses 20 generated by downhole system 40.

If the SNR is not greater than $T_{S1}$, method 90 moves from block 96 to block 92, where surface system 32 determines whether the SNR is greater than $T_{S2}$. If this is the case, then method 90 proceeds to block 104 where surface system 32 transmits instructions to downhole system 40 instructing it to increase the power of its transmissions. Method 90 then goes to block 106 where downhole system 40 acts on those instructions and increases the power of its transmissions by, for example, increasing the amplitude of uphole pulses 20A generated at downhole system 40. Increasing the magnitude of uphole pulses 20A may comprise, for example, reducing the size of an aperture of a value to be smaller than a previous size, or closing a valve for a longer period of time, or inducing more powerful vibrations in drilling fluid using a motor, valve, solenoid or other apparatus. If the SNR is not less than $T_{S2}$, then method 90 goes from block 102 to block 108 where no change to downhole system 40's transmission parameters is effected.

Thresholds $T_{A1}$, $T_{A2}$, $T_{S1}$ and $T_{S2}$ may be provided by a user, determined automatically, changed in response to a transmitted instruction, or otherwise determined. Such thresholds may vary according to the demands of a project (for example, certain projects may emphasize high-fidelity transmissions over high data rate transmissions), the particular hardware in use, or other factors. Thresholds $T_{S1}$ and $T_{S2}$ are preferably stored by surface system 32 and accessible to surface processor 38. Thresholds $T_{A1}$ and $T_{A2}$ may be stored by either or both of surface system 32 and downhole system 40. In particular, if downhole system 40 is configured to calculate APF, then it is preferable for $T_{A1}$ and $T_{A2}$ to be stored by surface system 32 and accessible to surface processor 38.

Figure 6:
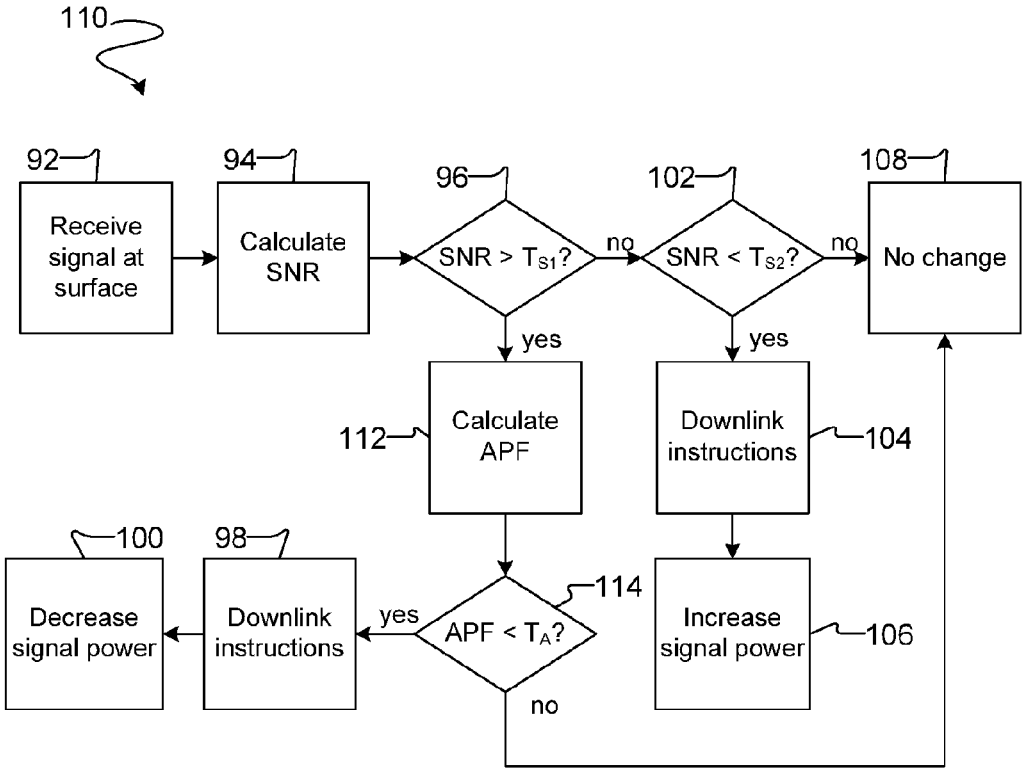
FIG. 6 is a block diagram of an example synthesized method.

FIG. 6 shows an example synthesized method 110. Blocks 92-108 are generally as described above in signal-to-noise adjustment method 90. Synthesized method 110 also uses portions of attenuation prediction method 50. In particular, block 112 corresponds generally to blocks 52-60; those steps have been combined into block 112 for the sake of clarity. In synthesized method 110, if the SNR is found to be greater than $T_{S1}$ in block 96, method 110 proceeds to block 112 (instead of proceeding directly to block 98).

At block 112, method 110 calls for surface system 32 to send a benchmark pulse (or pulses) to downhole system 40. Downhole system 40 measures the relevant characteristics and transmits that measurement as data to surface system 32. Surface system 32 receives and decodes that transmission and, based on that data, calculates APF as disclosed above. Alternatively, or in addition, downhole system 40 (and in particular downhole processor 44) measures the relevant characteristics and calculates APF as disclosed above.

Method 110 then goes on to block 114, where surface system 32 determines whether APF is less than the threshold $T_A$. If it is, then method 110 continues on to block 92 and then 100 to decrease transmission power at downhole system 40. If APF is not less than that threshold, then method 110 goes to block 108 and no change to downhole system 40's telemetry parameter is instructed. Alternatively, or in addition, downhole system 40 compares APF to the threshold $T_{A1}$ and downhole processor 44 performs the steps described at block 100 or 108, as appropriate (omitting, in this case, block 98).

Synthesized method 110 further improves the efficiency of attenuation prediction method 50 by deferring the calculation of APF until the SNR (measured at the surface) is sufficiently high. This saves energy at downhole system 40 by avoiding unnecessary calculations of APF. It also improves on signal-to-noise adjustment method 90 by more robustly predicting the likely attenuation of downhole-to-uphole signals.

It is common in mud pulse telemetry systems for mud pulses 20 to become too attenuated for operational use beyond a certain depth. In some embodiments, surface system 32 keeps track of the current configuration of downhole system 40's telemetry parameters, and, if it is not possible to increase the signal power of downhole system 40's mud pulses 20 to the desired level, surface processor 38 may flag an operator for example on a display 28. This may occur if, for example, the system determines that downhole system 40 should increase its signal power, but downhole pulse generator 46 is already generating maximum-amplitude pulses (for example, by fully closing a valve) and the duration of mud pulses 20 cannot be increased any further without reducing the rate of data transmission below a pre-set threshold or surpassing a maximum pulse duration threshold. An operator may take such a flag to indicate that a change of rotor, stator, gap height or other part of telemetry system 30 is required (e.g. to enable higher amplitude pulses), or that other corrective action is needed. Such a flag may result in MP telemetry being manually or automatically deactivated and/or for the system to transition to another available telemetry method, such as EM telemetry.

In some embodiments, surface system 32 responds to calculating APF or receiving a transmission encoding downhole system 40's measurement of the attenuation of a benchmark pulse by changing the rate of flow of drilling fluid in drill string 12. For example, when the rate of flow of the drilling fluid is increased, downhole system 40 may increase the amplitude of uphole pulses 20A without increasing, or even while decreasing, the duration of uphole pulses 20A.

While a number of exemplary aspects and embodiments have been discussed above, those of skill in the art will recognize certain modifications, permutations, additions and sub-combinations thereof.

For example, it is not mandatory in all embodiments that benchmark pulses propagate in the downhole direction. In some embodiments benchmark pulses may propagate uphole, For example, a benchmark pulse may be generated at downhole system 40 and received at a surface transducer. A measure of attenuation (e.g. an APF) may then be determined and downhole system 40 may be configured to transmit pulses with an intensity based at least in part on the measure of attenuation. Processing may be performed at surface equipment, downhole system 40, or may be distributed. In some embodiments, information comprising or derived from the strength of received benchmark pulses is transmitted from surface equipment to downhole system 40 by downlink EM telemetry.

It is therefore intended that the following appended claims and claims hereafter introduced are interpreted to include all such modifications, permutations, additions and sub-combinations as are within their true scope.

INTERPRETATION OF TERMS

Unless the context clearly requires otherwise, throughout the description and the "comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back", "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention. In particular, surface processor 38 and/or downhole processor 44 may be implemented as custom circuits, programmable chips, conventional logical processors, or any other form capable of providing the functions and performing the methods described above.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A mud pulse telemetry system comprising:

a first pulse sensor in fluid communication with a first pulse generator by way of a drillstring; and a second pulse generator in fluid communication with a second pulse sensor by way of the drillstring;

wherein:

the first pulse generator is configured to transmit a benchmark pulse with a known characteristic to the first pulse sensor, the benchmark pulse propagating in a first direction along the drillstring;

the first pulse sensor is configured to measure the known characteristic of the received benchmark pulse;

a first processor is configured to generate one or more telemetry parameters based at least in part on the known characteristic of the received benchmark pulse; and the first processor is configured to control and/or cause a second processor to control the second pulse generator to transmit to the second pulse sensor a set of one or more mud pulses according to the one or more telemetry parameters, the set of one or more mud pulsed propagating along the drillstring in a second direction opposite to the first direction wherein the first processor is configured to determine an attenuation prediction factor according to:

$$\text{attenuation prediction factor} = \frac{C_S - C_D}{C_S}$$

where: $C_S$ is the value of the known characteristic of the benchmark pulse at the time the benchmark pulse was transmitted by the first pulse generator and $C_D$ is the value of the known characteristic of the benchmark pulse as measured by the first pulse sensor.

2. A mud pulse telemetry system according to claim 1 wherein:

the first processor is provided by surface equipment in communication with the first pulse sensor and the second pulse generator.

3. A mud pulse telemetry system according to claim 1 wherein:

a second processor is provided in a downhole system that comprises the first pulse sensor and the second pulse generator;

the second processor is configured to control the second pulse generator to transmit to the second pulse sensor a set of reporting mud pulses encoding information regarding the known characteristic of the received benchmark pulse;

the first processor is configured to generate instructions to transmit to the second processor the set of telemetry parameters; and the second processor is configured to instruct the second pulse generator to transmit to the second pulse sensor a set of one or more mud pulses according to the set of telemetry parameters.

4. A mud pulse telemetry system according to claim 1 wherein the first processor is configured to:

compare the attenuation prediction factor to an upper attenuation threshold; and in response to determining that the attenuation prediction factor is greater than the upper attenuation threshold, generate a set of telemetry parameters corresponding to an increased transmission signal power.

5. A mud pulse telemetry system according to claim 4 wherein the first processor is configured to:

compare the attenuation prediction factor to a lower attenuation threshold; and in response to determining that the attenuation prediction factor is less than the lower attenuation threshold, generate a set of telemetry parameters corresponding to a decreased transmission signal power.

6. A mud pulse telemetry system according to claim 5 wherein the lower attenuation threshold and the upper attenuation threshold are equal.

7. A mud pulse telemetry system according to claim 5 wherein the lower attenuation threshold is less than the upper attenuation threshold.

8. A mud pulse telemetry system according to claim 1 wherein the system is configured to determine a signal-to-noise ratio in response to the second pulse sensor receiving at least one mud pulse from the second pulse generator.

9. A mud pulse telemetry system according to claim 8 wherein the system is configured to:

compare the signal-to-noise ratio to a lower signal-to-noise threshold; and in response to determining that the signal-to-noise ratio is less than the lower signal-to-noise threshold, generate a set of telemetry parameters corresponding to an increased transmission signal power.

10. A mud pulse telemetry system according to claim 9 wherein the lower signal-to-noise threshold is in the range 1.1 to 2.

11. A mud pulse telemetry system according to claim 9 wherein the first processor and/or the second processor are configured to:

compare the signal-to-noise ratio to an upper signal-to-noise threshold; and in response to determining that the signal-to-noise ratio is greater than the upper signal-to-noise threshold, generate a set of telemetry parameters corresponding to a decreased transmission signal power.

12. A mud pulse telemetry system according to claim 11 wherein the upper signal-to-noise threshold is in the range 2.5 to 10.

13. A mud pulse telemetry system according to claim 11 wherein the first processor and/or the second processor are configured to refrain from generating a set of telemetry parameters corresponding to a decreased transmission signal power in response to determining that the signal-to-noise ratio is greater than the upper signal-to-noise threshold if the attenuation prediction factor is less than an upper attenuation threshold.

14. A mud pulse telemetry system according to claim 11 wherein transmitting the set of one or more mud pulses according to a set of telemetry parameters corresponding to a decreased signal power comprises transmitting the set of one or more mud pulses with a decreased amplitude.

15. A mud pulse telemetry system according to claim 11 wherein transmitting the set of one or more mud pulses according to a set of telemetry parameters corresponding to a decreased signal power comprises transmitting the set of one or more mud pulses with a decreased pulse duration.

16. A mud pulse telemetry system according to claim 11 wherein transmitting the set of one or more mud pulses according to a set of telemetry parameters corresponding to a decreased signal power comprises transmitting the set of one or more mud pulses at an increased rate of data transmission.

17. A mud pulse telemetry system according to claim 11 wherein the signal power is decreased proportionately to the ratio of the attenuation prediction factor to an upper attenuation threshold.

18. A mud pulse telemetry system according to claim 11 wherein transmitting the set of one or more mud pulses according to a set of telemetry parameters corresponding to an increased transmission signal power comprises transmitting the set of one or more mud pulses with an increased amplitude.

19. A mud pulse telemetry system according to claim 11 wherein transmitting the set of one or more mud pulses according to a set of telemetry parameters corresponding to an increased transmission signal power comprises transmitting the set of one or more mud pulses with an increased pulse duration.

20. A mud pulse telemetry system according to claim 11 wherein transmitting the set of one or more mud pulses according to a set of telemetry parameters corresponding to an increased transmission signal power comprises transmitting the set of one or more mud pulses at a decreased rate of data transmission.

21. A mud pulse telemetry system according to claim 5 wherein the increase in the signal power is proportionate to the ratio of the attenuation prediction factor to the lower attenuation threshold.

22. A mud pulse telemetry system according to claim 1 wherein the system is configured to automatically transmit a benchmark pulse with the first pulse generator to the first pulse sensor after a flow-off.

23. A mud pulse telemetry system according to claim 1 wherein the system is configured to automatically transmit a benchmark pulse with the first pulse generator to the first pulse sensor when a drilling operation reaches a predetermined depth.

24. A mud pulse telemetry system according to claim 1 wherein the system is configured to automatically transmit a benchmark pulse with the first pulse generator to the first pulse sensor at a predetermined time.

25. A mud pulse telemetry system according to claim 1 wherein the system is configured to change a rate of flow of a drilling fluid in response to the measured known characteristic of the received benchmark pulse.

26. A mud pulse telemetry system according to claim 1 wherein the known characteristic is an amplitude of the benchmark pulse.

27. A mud pulse telemetry system according to claim 1 wherein the known characteristic is duration of the benchmark pulse.

28. A mud pulse telemetry system according to claim 1 wherein the known characteristic is a rate of change of the pressure of the benchmark pulse over a period of time.

29. A method for adjusting a transmission parameter for mud pulse telemetry, the method comprising:

at a first pulse generator, transmitting a benchmark pulse with a known characteristic by mud pulse telemetry;

allowing the benchmark pulse to propagate along a drill string to the first pulse sensor and at the first pulse sensor, measuring the known characteristic of the received benchmark pulse; and determining one or more pulse transmit parameters based at least in part on the known characteristic of the received benchmark pulse;

sending the pulse transmit parameters to a downhole system by way of EM downlink telemetry;

using the transmit parameters at the downhole system to transmit data to surface equipment by mud pulse telemetry;

determining an attenuation prediction factor based on the known characteristic of the received benchmark pulse and using the attenuation prediction factor to determine the pulse transmit parameters;

wherein the attenuation prediction factor is determined according to the following formula:

$$\text{attenuation prediction factor}=(Cs-Cd)/Cs$$

where Cs is the value of the known characteristic of the benchmark pulse at the time the benchmark pulse was transmitted by the first pulse generator and Cd is the value of the known characteristic of the benchmark pulse as measured by the first pulse sensor.

30. A method according to claim 29 wherein the known characteristic is an amplitude of the benchmark pulse.

31. A method according to claim 29 wherein the known characteristic is a duration of the benchmark pulse.

32. A method according to claim 29 wherein the known characteristic is a rate of change of a pressure of the benchmark pulse over a period of time.

33. A method according to claim 29 comprising: comparing the attenuation prediction factor to a lower attenuation threshold; and in response to determining that the attenuation prediction factor is less than the lower attenuation threshold, setting the downhole system to transmit mud pulses at a decreased signal power.

34. A method according to claim 33 comprising:

comparing the attenuation prediction factor to an upper attenuation threshold; and in response to determining that the attenuation prediction factor is greater than the upper attenuation threshold, setting the downhole system to transmit mud pulses at an increased signal power.

35. A method according to claim 34 wherein the lower attenuation threshold and the upper attenuation threshold are equal.

36. A method according to claim 34 wherein the lower attenuation threshold is less than the upper attenuation threshold.

37. A method according to claim 29 comprising determining a signal-to-noise ratio in response to a second pulse sensor receiving at least one mud pulse of a set of one or more mud pulses from a second pulse generator.

38. A method according to claim 37 comprising:

comparing the signal-to-noise ratio to a lower signal-to-noise threshold; and in response to determining that the signal-to-noise ratio is less than the lower signal-to-noise threshold, transmitting the set of one or more mud pulses at an increased signal power.

39. A method according to claim 38 wherein the lower signal-to-noise threshold is in the range 1.1 to 2.

40. A method according to claim 38 comprising:

comparing the signal-to-noise ratio to an upper signal-to-noise threshold; and in response to determining that the signal-to-noise ratio is greater than the upper signal-to-noise threshold, transmitting the set of one or more mud pulses at a decreased signal power.

41. A method according to claim 40 wherein the upper signal-to-noise threshold is in the range 2.5 to 10.

42. A method according to claim 40 comprising determining an attenuation prediction factor based on the known characteristic of the received benchmark pulse and using the attenuation prediction factor to determine the pulse transmit parameters and transmitting the set of one or more mud pulses at a power that is not decreased in response to determining that the signal-to-noise ratio is greater than the upper signal-to-noise threshold if the attenuation prediction factor is less than the upper attenuation threshold.

43. A method according to claim 40 wherein transmitting the set of one or more mud pulses at a decreased signal power comprises transmitting the set of one or more mud pulses with a decreased amplitude.

44. A method according to claim 40 wherein transmitting the set of one or more mud pulses at a decreased signal power comprises transmitting the set of one or more mud pulses with a decreased pulse duration.

45. A method according to claim 40 wherein transmitting the set of one or more mud pulses at a decreased signal power comprises transmitting the set of one or more mud pulses at an increased rate of data transmission.

46. A method according to claim 40 wherein the signal power is decreased proportionately to the ratio of the attenuation prediction factor to an upper attenuation threshold.

47. A method according to claim 40 wherein transmitting the set of one or more mud pulses at an increased signal power comprises transmitting the set of one or more mud pulses with an increased amplitude.

48. A method according to claim 40 wherein transmitting the set of one or more mud pulses at an increased signal power comprises transmitting the set of one or more mud pulses with an increased pulse duration.

49. A method according to claim 40 wherein transmitting the set of one or more mud pulses at an increased signal power comprises transmitting the set of one or more mud pulses at a decreased rate of data transmission.

50. A method according to claim 43 wherein the signal power is increased proportionately to the ratio of the attenuation prediction factor to a lower attenuation threshold.

51. A method according to claim 50 wherein the signal power is increased relative to a baseline value.

52. A method according to claim 50 wherein the signal power is increased relative to the current signal power.

53. A method according to claim 29 comprising automatically transmitting a benchmark pulse after a flow-off.

54. A method according to claim 29 comprising automatically transmitting a benchmark pulse when a drilling operation reaches a predetermined depth.

55. A method according to claim 29 comprising automatically transmitting a benchmark pulse at a predetermined time.

56. A method according to claim 29 comprising changing a rate of flow of a drilling fluid in response to determining an attenuation prediction factor.

* * * * *